US007273233B2

(12) United States Patent
Möller

(10) Patent No.: US 7,273,233 B2
(45) Date of Patent: Sep. 25, 2007

(54) SKI CLIP

(75) Inventor: Wolfgang Möller, Bochum (DE)

(73) Assignee: Kerstin Moller, Bochum (DE)

( * ) Notice: Subject to any disclaimer, the term of this patent is extended or adjusted under 35 U.S.C. 154(b) by 0 days.

(21) Appl. No.: 10/513,417

(22) PCT Filed: May 2, 2003

(86) PCT No.: PCT/EP03/04616

§ 371 (c)(1),
(2), (4) Date: Jun. 14, 2005

(87) PCT Pub. No.: WO03/092830

PCT Pub. Date: Nov. 13, 2003

(65) Prior Publication Data

US 2005/0236830 A1 Oct. 27, 2005

(30) Foreign Application Priority Data

May 3, 2002 (DE) ..... 102 20 003
Nov. 22, 2002 (DE) ..... 102 54 528

(51) Int. Cl.
*A63C 11/02* (2006.01)

(52) U.S. Cl. ..... 280/814; 280/809

(58) Field of Classification Search ..... 24/329, 24/336, 338, 326, 327, 339; 280/814, 809, 280/820, 815, 819
See application file for complete search history.

(56) References Cited

U.S. PATENT DOCUMENTS 783,906 A * 2/1905 Spielman ..... 24/67.11
2,340,868 A * 2/1944 Dye ..... 104/202
2,597,275 A * 5/1952 Ahlstrand ..... 248/37.6
3,626,553 A * 12/1971 Darney et al. ..... 280/814

(Continued)

FOREIGN PATENT DOCUMENTS

DE 296 04 646 7/1996

(Continued)

*Primary Examiner*—Christopher P. Ellis
*Assistant Examiner*—John D Walters
(74) *Attorney, Agent, or Firm*—Collard & Roe, P.C.

(57) ABSTRACT

The invention relates to a ski clip, which is used to fasten ski poles (6*a*, 6*b*) to skis (7). In general the simultaneous transport of a pair of skis (7)and a pair of ski poles (6*a*, 6*b*) poses problems as the use of both hands is required. It is therefore difficult to simultaneously hold the skis (7), ski poles (6*a*, 6*b*) and other objects or to hold onto retaining bars in buses and gondolas when transporting skis (7). The disadvantage of attachments for solving said problem in prior art is that the ski pole holders have to be stored separately when not in use and in addition are inconvenient to use. The invention solves said problem by the permanent attachment of a fixing device (1*a*, 1*b*) to the ski pole (6*a*, 6*b*), whereby a forked clamping piece (5*a*, 5*b*) that can be folded out is fastened to said fixing device and a pair of skis (7) can be clamped between the limbs (9) of said piece. By attaching a forked clamping piece (5*a*, 5*b*) to each side of a pair or skis (7), not only are the ski poles (6*a*, 6*b*) fastened to the skis (7), but the skis (7) are also held together. This permits the skis (7) and ski poles (6*a*, 6*b*) to be transported in one hand.

7 Claims, 3 Drawing Sheets

U.S. PATENT DOCUMENTS

Figure 1:
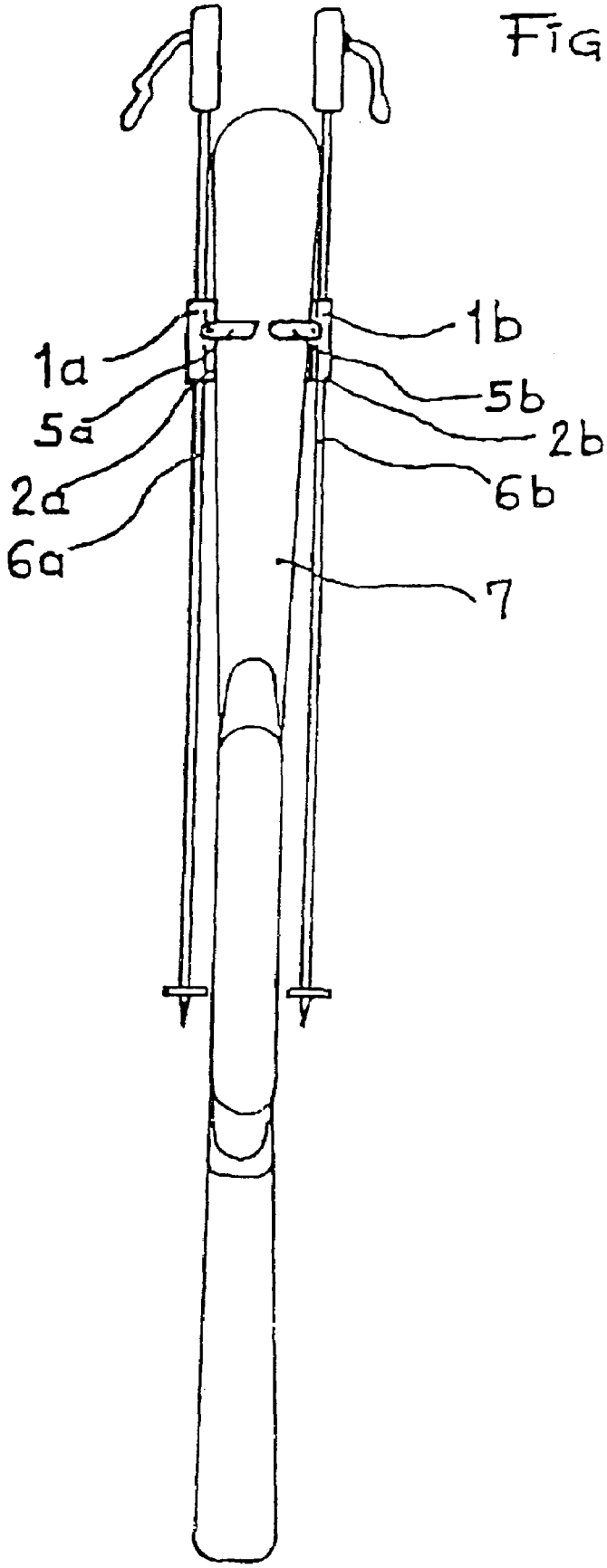

| | | | | | |
|---|---|---|---|---|---|
| 3,778,537 | A | * | 12/1973 | Miller | 174/138 R |
| 3,936,067 | A | | 2/1976 | Link | |
| 4,002,349 | A | | 1/1977 | Dopp | |
| 4,134,182 | A | * | 1/1979 | Ramsby | 280/814 |
| 4,718,138 | A | * | 1/1988 | Brown et al. | 15/237 |
| 4,953,892 | A | * | 9/1990 | Adkins | 280/814 |
| 5,094,479 | A | * | 3/1992 | Shields | 280/814 |
| 6,345,843 | B1 | * | 2/2002 | Barnes | 280/823 |
| 6,430,782 | B1 | * | 8/2002 | Torres et al. | 24/3.1 |

FOREIGN PATENT DOCUMENTS

| | | |
|---|---|---|
| DE | 202 18 145 | 3/2003 |

* cited by examiner

SKI CLIP

CROSS REFERENCE TO RELATED APPLICATIONS

Applicants claims priority under 35 U.S.C. §119 of German Application No. 102 20 003.3 filed May 3, 2002 and German Application No. 102 54 528.6 filed Nov. 22, 2002. Applicant also claims priority under 35 U.S.C. § 365 of PCT/EP03/04616 filed on May 2, 2003. The international application under PCT article 21(2) was not published in English.

The invention relates to a ski clamp that can be affixed to the ski pole and set onto the skis, so that a connection between the skis and the ski poles is achieved, which significantly facilitates simultaneous transport.

At present, commercially available skis are usually put together for transport, for example on the way from the lodgings to the gondola, to the lift, or to the ski bus, with the running surfaces facing one another. Since the running surfaces can, under some circumstances, quickly come apart again, transport in this manner is rather complicated. To facilitate transport, bands with which the skis are held together can be used.

Although an improvement in the transport of the skis themselves can be achieved in this manner, the problem that the ski poles must generally be held with the remaining free hand continues to exist. Since there is now no longer a hand free, there are many difficulties, for example when presenting or inserting lift tickets, holding on in a bus or the gondola, or also when transporting additional objects.

Different approaches for solving the problems described above are known from the state of the art. For example, the German utility model DE 296 04 646 U1 discloses a ski pole holder that consists of two bands, the first of which surrounds the skis, the second the ski poles. Attachment takes place by means of a hook-and-loop closure.

Disadvantages of the solution from the state of the art as described above consist in the fact that the ski pole holders must always be stored separate from the ski poles and the skis, if they are not needed at that particular time. Experience has shown that this leads to the result that such holders are easily lost or cannot be found quickly enough. Furthermore, the method of attachment, by winding the hook-and-loop band that is used around the skis and threading it through is relatively complicated, particularly when wearing gloves, so that it can be expected that such ski pole holders will not be used frequently in practical situations.

Another solution approach consists, according to the U.S. Pat. No. 4,002,349, in using a ski clip consisting of two oblong segments, connected with one another and circular in cross-section, whereby each of the segments has an opening. These openings lie opposite one another and lead to the effect that the segments can be used as clamps, whereby the two segments have different diameters. In this connection, two skis placed with their running surfaces together can be clamped between the wings of the larger clamp, and a ski pole can be clamped between the wings of the smaller clamp. By using one ski clip on the two sides of the skis, in each instance, one thereby gains the possibility of bringing two skis and two ski poles together into a unit.

However, a disadvantage that becomes noticeable with this state of the art is that the ski clips stand away to the side from the ski poles, to a great degree, when they are not needed to fix the skis in place. This is disadvantageous not only for esthetic reasons, but also represents a hindrance while skiing. Because of the comparatively sharp edges, the skier can touch his/her leg with the ski clip while skiing, and can become entangled with it. Possible results are falls and damage to the clothing. If the skier wishes to avoid this, he/she is forced to remove the ski clip from the ski poles while skiing, and to put it away, and this again clearly restricts the ease of use.

Another problem can be seen in that the running surfaces of the carving skis that are usual today touch one another only at the front and the back when the skis are placed against one another, while there is a great curvature in between. Accordingly, the diameter of the segment intended to accommodate the skis would have to be so large that the ski clip would become difficult to handle and almost impossible to put away, if only for that reason. The problem is further intensified by the reinforcements that are frequently found in the front region of the skis.

It is therefore the task of the invention to make available a ski clamp that can be attached directly to the ski pole, without bringing the disadvantages described above with it, and allows simple carrying of the ski poles in combination with the skis.

This task is accomplished, according to the invention, by means of a ski clamp that can be attached to the ski pole and has a forked clamping piece, between the shanks of which the skis can be clamped, whereby the forked clamping piece is affixed to a holder that can be fixed in place on the ski pole, so as to flip out.

The forked clamping pieces according to the invention have two shanks, whereby the clamping effect is great enough to hold the skis securely, without, on the other hand, making it impossible to release it from the skis. The forked clamping piece, in turn, is affixed to a holder that can be connected with a ski pole. In order to transport a pair of skis and ski poles, it is therefore practical to use a holder on each ski pole, and their forked clamping pieces can be set onto the sides of the skis, in each instance. The attachment of the forked clamping pieces can take place in the upper region of the skis, below the ski tips. In this connection it is possible to push the forked clamping pieces on the ski poles down along the pair of skis until the ski poles are held firmly. This is particularly facilitated in that commercially available skis lie directly against one another only at their ends when the running surfaces are placed against one another, while there is a curvature in the middle.

The forked clamping piece is attached to the holder so as to flip out, so that it rests tightly against the ski pole when it is not in use. In this connection, it can be connected with the holder in its upper region by means of a hinge, a screw, a rivet or the like. Forked clamping pieces that can flip in, in this manner, project beyond the ski pole, on the side, only to an insignificant extent, and therefore represent practically no impairment any more while skiing. Because of the slim appearance in the flipped-in state, this is an improvement of the state of the art also from esthetic points of view.

Because of this flipping in, it is practical to provide an accommodation for the forked clamping piece in the holder, which accommodation is configured in such a manner that it can accommodate the forked clamping piece with an accurate fit. In this connection, it is possible for the shanks of the forked clamping piece to lie freely exposed to the sides, in the flipped-in state, or that they are surrounded, on one or both sides, by the accommodation provided. It is advantageous if the accommodation consists of two individual recesses, open to the side or closed, which can accommodate the shanks of the forked clamping piece. The accommodation itself should be configured in such a manner that no sharp edges occur, which would represent an injury potential while skiing, and that the holder, with the flipped-in forked clamping pieces, offers as compact an appearance as possible, as a whole.

It is practical if the holder itself is permanently fixed in place on the ski pole. As already explained above, this makes the bothersome search for a ski pole holder in a number of different pockets unnecessary, and furthermore prevents the holder from becoming easily lost. It is practical if the holder has an at least partially pipe-shaped segment, through which part of the ski pole runs. In this manner, the holder can be affixed to the ski pole so as not to slip or rotate. In this connection, the inside diameter of the pipe-shaped segment should be coordinated with the diameter of typical ski poles. Various possibilities are possible for fixation. For example, the pipe-shaped segment can be open on the side, when viewed in cross-section, so that the holder can be set onto the ski pole. In this manner, a ski clamp which can be easily fitted to conventional ski poles is made available. Alternatively, the pipe-shaped segment can also consist of two semicircular-shaped parts, which are connected with one another only after being set onto the ski pole. This connection can take place by means of a screw or a bolt, for example.

On the side, one or more, preferably two recesses can be provided in the pipe-shaped segment, by means of which the forked clamping piece is released for contact from the side facing the ski pole in the assembled state. In this manner, the skier can grasp behind the shanks of the forked clamping piece, in order to flip them out. Since rather bulky gloves are generally worn while skiing, this represents a great facilitation.

In addition to the holder described above, with which commercially available ski poles can be re-fitted, the production of ski poles on which a holder for a forked clamping piece as described above is already configured as an integral part of the ski pole itself is also possible.

In order to carry the skis together with the ski poles, the forked clamping pieces must lie crosswise to the length of the skis as well as of the ski poles in the flipped-out state. So that the mass of the ski poles does not pull them down when the skis are lifted, thereby making it possible for the forked clamping pieces to come loose from the skis again, a device should be present in the region of the joint about which the forked clamping piece can be rotated, which limits the maximum angle between the ski pole and the forked clamping piece to 70 to 110° when the piece is flipped out, preferably to approximately 90°. This can be done, for example, by means of a corresponding configuration of the accommodation in the holder, or also by means of a projection against which the forked clamping piece makes contact in the fully flipped-out state, so that further flipping movement is prevented.

The accommodation on the holder can have a device, for example a bolt or projection, by means of which the forked clamping piece is fixed in place in the accommodation in the flipped-in state. In this manner, it is prevented that the clamping piece flips out unintentionally, for example when simply holding the ski pole at a slant. There are numerous possibilities for fixing the forked clamping piece in place in the accommodation in the lower region, but these should be structured so that the clamping piece can be released from the fixation again and flipped out, by applying only a slight force.

This can be done in that a notch or a slit is let into the forked clamping piece at the corresponding location, which is shaped so that the projection slides into this notch within the accommodation of the holder as soon as the clamping piece is flipped in. In this manner, the clamping piece is held in the flipped-in state, but can be easily flipped out again.

An alternative possibility consists in that the shanks of the forked clamping piece merely have a hole that can be set onto the projection within the accommodation of the holder, in that the shanks of the forked clamping piece are slightly bent to the side.

Instead of providing a device for locking the forked clamping piece in place in the flipped-in state, it is also possible, however, to configure the connection between the forked clamping piece and the holder in such a manner that the forked clamping piece can be flipped out only when applying a certain measure of force.

Figure 2:
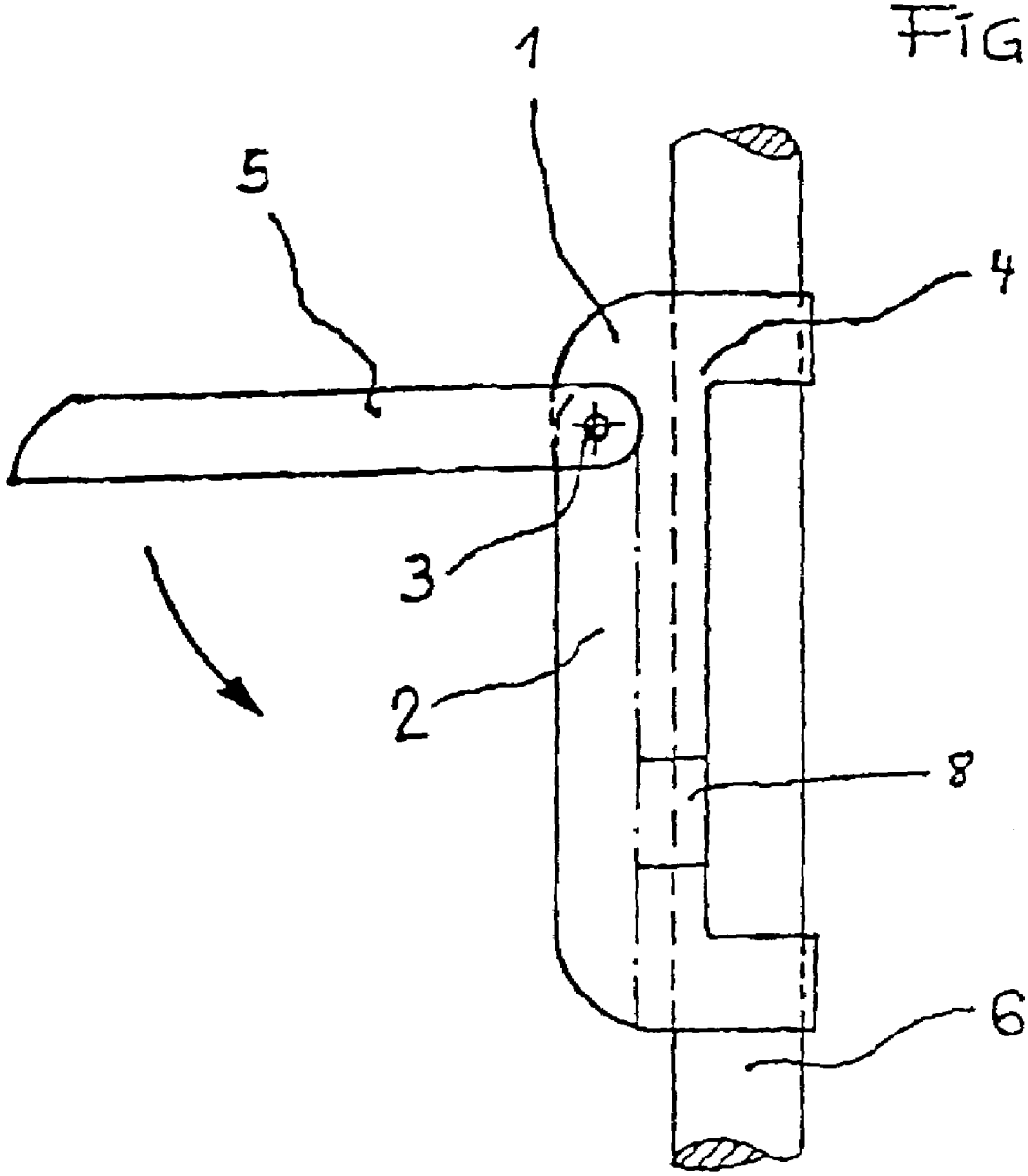
Figure 3:
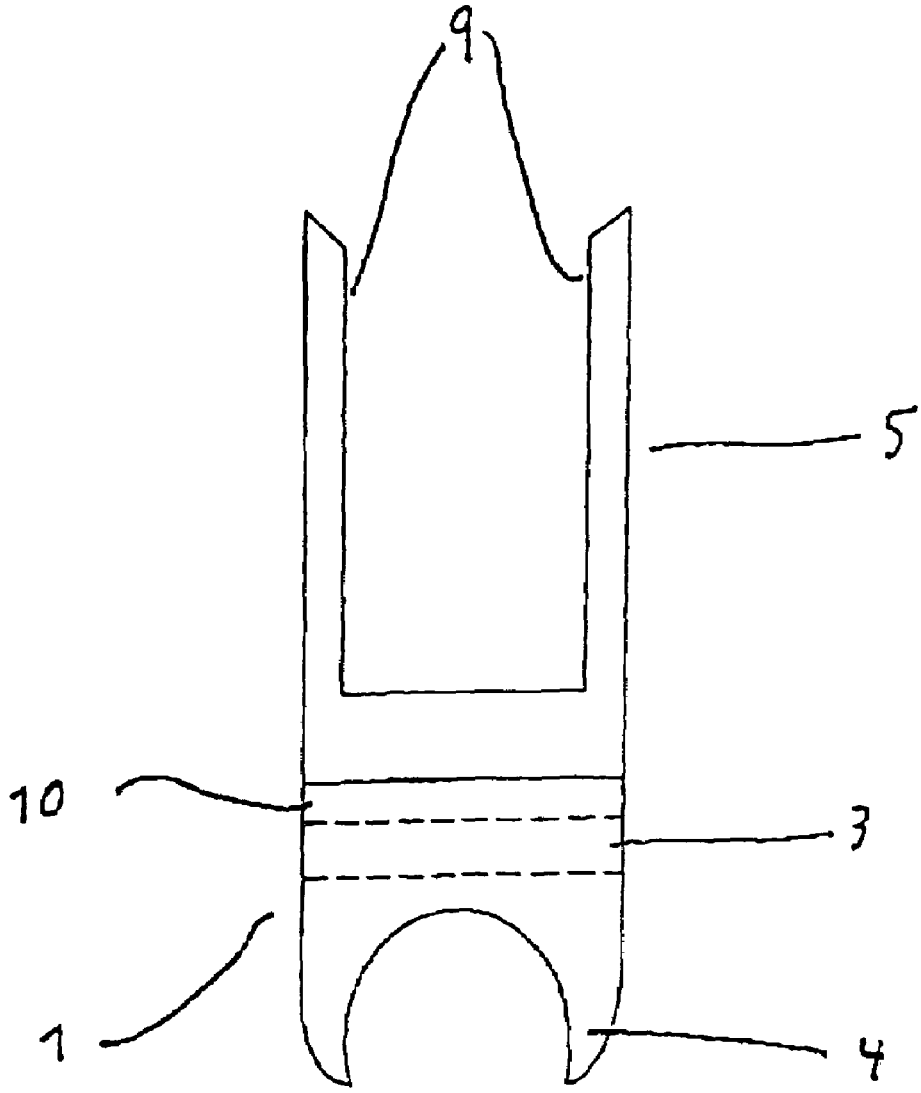

The following description as well as the attached drawings clarify advantageous embodiments of the invention. The drawings show:

FIG. 1: a pair of skis, with a ski pole attached on each side, using the ski clamp according to the invention, in a frontal view;

FIG. 2: a magnified view of a ski clamp fixed in place on a ski pole, with a holder to which a forked clamping piece is affixed, so as to flip out;

FIG. 3: a ski clamp according to the invention, with the forked clamping piece flipped out, in a top view.

The use of the ski clamp according to the invention is shown in FIG. 1. Here, one sees a pair of skis 7, onto which a forked clamping piece 5*a*, 5*b* is set in the upper region, on the right and the left, in each instance. The forked clamping pieces 5*a*, 5*b* are connected with the holders 1*a*, 1*b* so as to rotate, and the latter in turn are attached to the ski poles 6*a*, 6*b*. The holders 1*a*, 1*b* have accommodations 2*a*, 2*b* for the forked clamping pieces 5*a*, 5*b* in their folded position. By lifting the skis 7, there is a combination in the form shown, so that four individual parts can be easily carried in one hand or also carried on the shoulder. The structure represents a particular advantage particularly if one has to hold on with the other hand, which is now free, at the same time, for example in a bus or in a gondola. At the same time, the structure shown also represents an improvement for storing the skis 7, which can be set down in the manner shown, or set into packed snow, for example. Accordingly, confusion of skis 7 and ski poles 6*a*, 6*b* is hardly possible any more.

FIG. 2 shows a detail of a ski pole 6 onto which a holder 1 is set, which has an accommodation 2 for the forked clamping piece 5 on the side. In the upper region, the accommodation 2 is provided with a continuous bore 3 for accommodating a bolt or the like, on which the shanks of the forked clamping piece 5 can be attached so as to rotate. At the same time, the connection between the two shanks is produced in this manner. The shanks of the forked clamping piece 5 can be flipped out of the flipped-in position by an angle of 90°.

The holder 1 has a pipe-shaped segment 4 that is open towards the side. In this manner, the holder can be easily set onto a conventional ski pole 6, and thereby fixed in place. This fixation is resistant to slipping and rotation if the inside diameter of the pipe-shaped segment is suitably coordinated with the outside diameter of the ski pole, without applying any external force. If necessary, however, the holder 1 can be shifted in place on the ski pole 6. The pipe-shaped segment 4 has recesses 8 on the side, at which the user can grasp behind the shanks of the forked clamping piece 5 in the flipped-in state.

In FIG. 3, the ski clamp according to the invention is shown in a top view, with the forked clamping piece 5 flipped out. The forked clamping piece 5 has two shanks 9, between which the skis, which have been laid against one another with their running surfaces, can be clamped in place. The holder 1 comprises a pipe-shaped segment 4 that can be set onto a ski pole. The forked clamping piece 5 is mounted on the holder 1 to rotate about a bolt located in the bore 3, a joint or the like, whereby a projection 10 as part of the holder 1 has the effect that the forked clamping piece 5 with its shanks 9 cannot be flipped out further than by an angle of 90°.

The attached drawings merely represent a possible embodiment of the invention. Of course, esthetically particularly pleasing configurations of ski clamps are also possible, without leaving the scope of the invention.

Various materials are possible for the production of the ski clamps according to the invention. For example, the holder 1 itself can be made of breakage-resistant plastic, which has clear weight advantages as compared with metal. The shanks 9 of the forked clamping piece 5 can be produced from thin, elastic metal sheets, for example, or also of plastic.

The invention claimed is:

1. A ski clamp comprising:

(a) a holder fixable in place on a ski pole comprising first and second recesses; and (b) a forked clamping piece comprising first and second shanks, said forked clamping piece being swivel-mounted to the holder for movement between an extended-out state for clamping a pair of skis between the shanks and a retracted-in state wherein said first shank is accommodated in said first recess and said second shank is accommodated in said second recess so that the shanks do not project significantly beyond the ski pole.

2. The ski clamp as recited in claim 1 wherein the holder has an at least partial pipe-shaped segment that is suitable for partial accommodation of the ski pole.

3. The ski clamp as recited in claim 2, wherein the pipe-shaped segment is open on a cross-sectional side and can be set onto the ski pole.

4. The ski clamp as recited in claim 2, wherein the pipe-shaped segment has at least one side recess for facilitating pivoting of the shanks into the extended-out state.

5. The ski clamp as recited in claim 1, wherein the holder is an integral part of the ski pole.

6. The ski clamp as recited in claim 1, wherein the holder has a device that limits an angle between the ski pole and the forked clamping piece, in in the extended-out state, to a value between 70° and 110°.

7. The ski clamp as recited in claim 1, wherein the holder has a device that locks the first and second shanks in place in the first and second recesses respectively in the retracted-in state.

* * * * *